United States Patent [19]

Kelley, Jr.

[11] 3,936,726

[45] Feb. 3, 1976

[54] GATING CONTROL FOR A STATIC SWITCHING ARRANGEMENT WITH IMPROVED DYNAMIC RESPONSE

[75] Inventor: Fred W. Kelley, Jr., Media, Pa.

[73] Assignee: General Electric Company, Philadelphia, Pa.

[22] Filed: Sept. 3, 1974

[21] Appl. No.: 503,143

[52] U.S. Cl. ..... 323/24; 307/252 T; 307/252 UA; 323/22 SC

[51] Int. Cl.[2] ..... G05F 1/56

[58] Field of Search ..... 323/22 SC, 24, 34–38, 323/39; 321/16, 18, 38; 307/252 T, 252 UA

[56] References Cited

UNITED STATES PATENTS 3,470,450 7/1966 Eriksson et al. ..... 321/16

3,665,293 5/1972 Kelley et al. ..... 323/24

3,693,069 9/1972 Kelley et al. ..... 323/24

*Primary Examiner*—Gerald Goldberg

*Attorney, Agent, or Firm*—J. Wesley Haubner

[57] ABSTRACT

To control the gating angles and hence the subsequent conduction angles of a complementary pair of alternately fired controllable electric valves, there is provided during intermittent intervals when neither valve is conducting a gating control signal which depends on the sum of a control signal indicative of a desired conduction angle, an on-time indicating signal indicative of the actual conduction angle of the last conducting valve, and an off-time indicating signal that varies with the duration of the non-conducting interval. Each time the gating control signal reaches a predetermined threshold level, the next to conduct valve is fired.

8 Claims, 2 Drawing Figures

Figure 2:
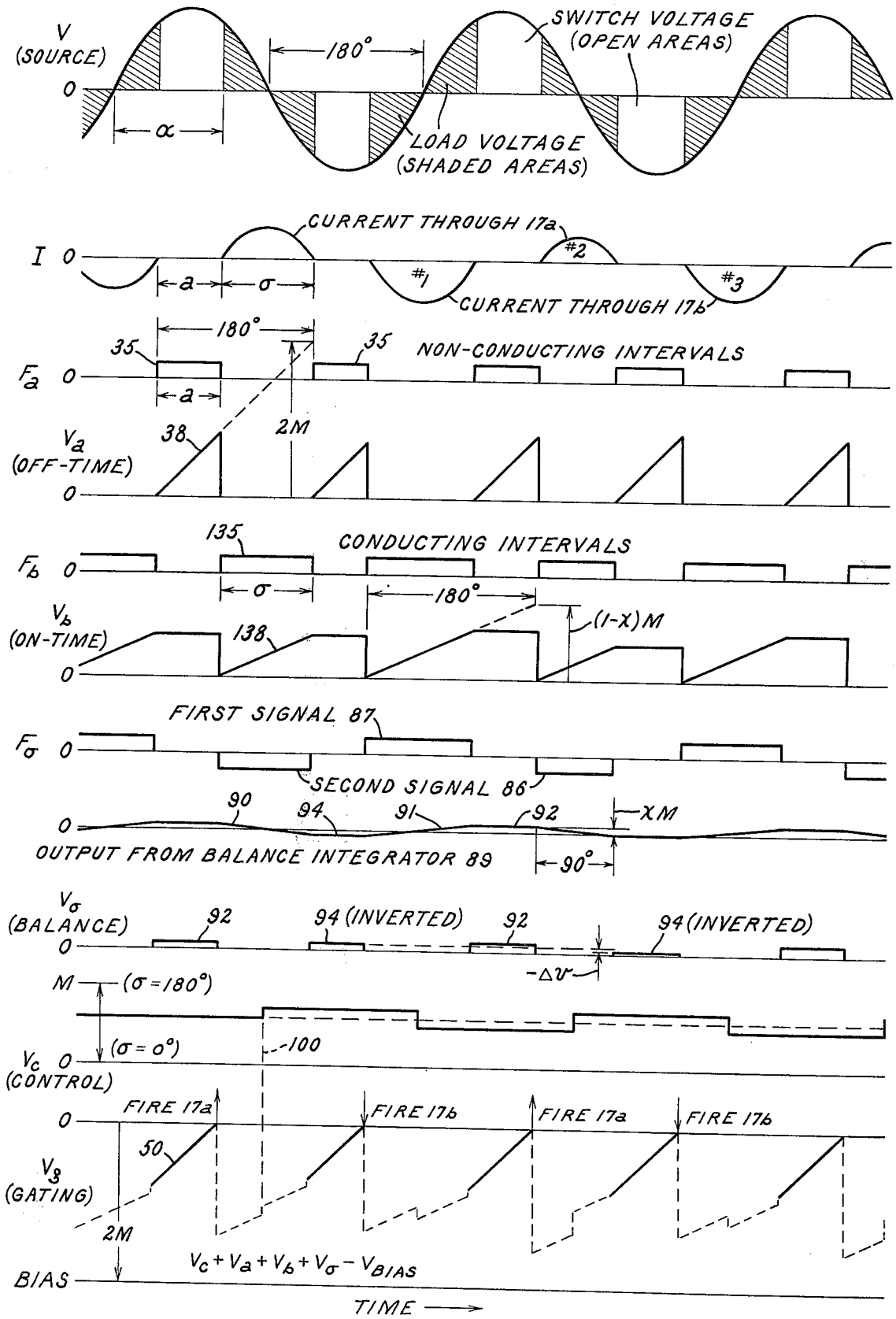

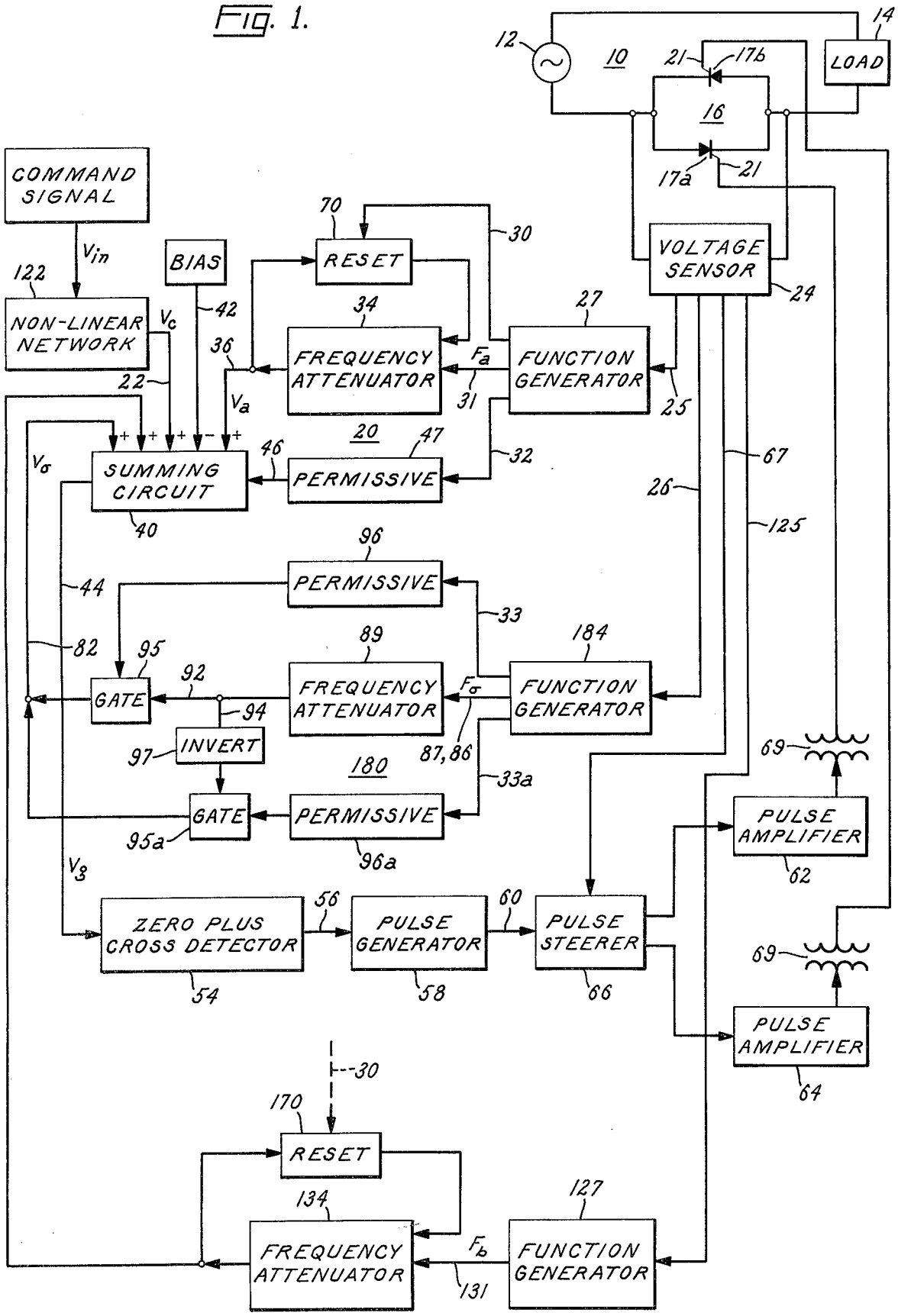
Fig. 1.
COMMAND SIGNAL
$V_{in}$
122
NON-LINEAR NETWORK
$V_c$
22
BIAS
42
36
$V_a$
70
RESET
30
34
FREQUENCY ATTENUATOR
$F_a$
31
27
FUNCTION GENERATOR
25
VOLTAGE SENSOR
24
12
10
21
17b
16
17a
21
14
LOAD
20
47
46
PERMISSIVE
32
SUMMING CIRCUIT
40
$V_\sigma$
26
67
125
96
PERMISSIVE
33
44
82
95
GATE
92
94
INVERT
97
89
FREQUENCY ATTENUATOR
$F_\sigma$
87,86
184
FUNCTION GENERATOR
180
33a
GATE
95a
PERMISSIVE
96a
$V_3$
69
PULSE AMPLIFIER
62
ZERO PLUS CROSS DETECTOR
54
56
PULSE GENERATOR
58
60
PULSE STEERER
66
69
PULSE AMPLIFIER
64
30
170
RESET
134
FREQUENCY ATTENUATOR
$F_b$
131
127
FUNCTION GENERATOR

GATING CONTROL FOR A STATIC SWITCHING ARRANGEMENT WITH IMPROVED DYNAMIC RESPONSE

This invention relates to gating controls for a complementary pair of alternately conducting controllable electric valves which are triggered or fired in repetitive sequence so as to allow a first half cycle of current to flow through one of the valves and the successive half cycle of current to flow through the other valve, and more particularly it relates to a gating control capable of varying the "gating angle" at which the valves are cyclically fired so as to control the subsequent "conduction angle" of each valve in turn.

In a typical application for the subject invention, the pair of valves to be controlled comprise at least first and second unidirectionally conducting solid state semiconductor switching devices known as thyristors which are connected in inverse parallel relationship with one another to form an a-c static switch, and this switch is used in an electric power system to control the magnitude of current flowing between a source of alternating voltage and an electric load circuit. Such a static switch is open when all of its constituent thyristors are turned off, and it is closed when the thyristors are turned on and conducting. The inversely poled thyristors conduct alternately, being cyclically fired by the associated controls in synchronism with the source voltage. The moment of firing is conveniently expressed as an electrical angle referenced to zero crossings of the source voltage, which angle is herein referred to as the gating angle ($\alpha$). Once fired the first thyristor allows current to start flowing in a forward direction through the load circuit, and its conducting state will continue until the next natural current zero. Similarly, the inversely poled second thyristor once fired will conduct a half cycle of reverse load current.

The time during which a thyristor conducts following its firing is herein referred to as the conduction angle ($\sigma$). When this conduction angle for each thyristor of the switch is substantially 180° (a half cycle of the fundamental frequency of the source voltage), the switch is considered to be fully on; when $\sigma = 0°$ the switch is considered to be fully off. Between these limits the switch has an intermittent on-off duty cycle: during the conducting intervals of the switch the load circuit is excited by the source voltage, and during each of the intermittent intervals when none of the thyristors is conducting, the load is deenergized and the switch withstands voltage.

The amount of fundamental current that the switch conducts between the source and the load can be varied from zero to maximum by varying the conduction angle of the switch from its full-off limit (0°) to its full-on limit (180°). The conduction angle can be varied by appropriately varying (retarding or advancing) the gating angle at which the switch thyristors are fired, popularly known as "phase control". However, the conduction angle also depends on the power factor of the circuit in which the switch is connected, and therefore the gating angle range for full control of the switch will vary as a function of power factor. For any given power factor, the most advanced firing (fully-on state of the switch) is obtained when the gating angle is coincident with current zero for that power factor. For example, the most advanced gating angle is 0° for a unity power factor (resistive) circuit, −90° for a zero leading power factor (capacitive) circuit, and +90° for a zero lagging power factor (inductive) circuit.

To automatically provide the proper gating angle control range for a static switch in a power circuit characterized by a variable power factor, the proportional control mechanism described and claimed in U.S. Pat. No. 3,665,293-Kelley et al, assigned to the General Electric Co., can be employed. According to the teachings of that patent, the gating angle is determined by the magnitude of a gating control signal which depends on the sum of an external command signal, the magnitude of which is variable between 0 and 1 per unit (positive), and an off-time indicating signal which varies in magnitude as a direct function of the duration of each non-conducting or blocking interval of the switch. During each non-conducting interval the latter signal rises from zero at a rate of 1 per unit per 180°. Each time the gating control signal reaches a predetermined threshold level (equivalent to 1 per unit), the next-to-conduct thyristor is fired. Consequently, under symmetrical, steady state conditions the conduction angle of the switch will be approximately proportional to the command signal magnitude regardless of the power factor of the circuit.

In applying this approach to switches that are used in power circuits that have low power factors, such as predominantly inductive circuits, a difficulty is encountered because in this case the angle at which each thyristor stops conducting and an off interval of the switch begins is dependent on the previous gating angle. As a result, any change in the command signal magnitude to advance or retard the gating angle tends to force the switch into an undesirable asymmetrical conducting condition in which the conduction angles of the thyristor which conducts half cycles of forward load current are unequal to those of the oppositely conducting thyristor. For example, if the gating angle were suddenly decreased by a step increase in the command signal, the conduction angle of the thyristor whose firing was advanced will become longer than desired and the succeeding conduction angle will be correspondingly shorter than desired, whereby only their sum remains correctly proportional to the new command signal magnitude. The lower the power factor of the power system, the more severe this unbalance tendency becomes. For a purely inductive load (e.g., an inductor having negligible resistance compared to its inductive reactance), where $\sigma = 2(180° - \alpha)$, the first conduction angle to respond to a step change in the command signal will exhibit twice the desired change.

To alleviate this problem, the control mechanism of the aforesaid Kelley et al patent includes conduction angle balancing means which measures and compares the conduction angles of the two thyristors on successive half cycles. If the compared angles are unequal, a balance-indicating signal is derived, and this signal is used to shift the gating angle of a preselected one of the thyristors in a direction and by an amount to restore the balance. In an improved version of this conduction angle balancing means, as disclosed and claimed in U.S. Pat. No. 3,693,069-Kelley et al, successive conduction angles are equalized by advancing the gating angle of the thyristor associated with a deficient conduction angle and by retarding the gating angle of the thyristor associated with an excessive conduction angle.

While the above-described conduction angle balancing techniques are satisfactory for many applications, when used in the gating controls of static switches which deliver power in highly inductive circuits their dynamic response may not be ideal. Because the prior techniques engender after-the-fact correction of a conduction angle imbalance, they are ineffective to prevent a substantial overshoot of the initial conduction angle of the thyristor that is next fired following a step change in the command signal. Once effective, their response might be underdamped or oscillatory, in which case the balance error could be unacceptably high.

Accordingly, a general objective of the present invention is to improve the dynamic response of gating controls of the kind disclosed in the above-referenced Kelley et al patents.

Another object of this invention is the provision, for controlling the conduction angles of a complementary pair of alternately conducting electric valves used to control the magnitude of alternating current in an electric power circuit having relatively low power factor, of a gating control characterized by an optimum damped response to step changes in the command signal over a full range of conduction angles.

A more specific object of my invention is the provision of a gating control, for a reactive current conducting static switch, having improved means for substantially preventing initial conduction angle overshoot in response to a step change in command signal and for maintaining virtual equality between successive conduction angles in the presence of steady-state unbalancing influences.

Yet another object is to linearize the magnitude relationship between the variable command signal which is applied to such a gating control and the fundamental current which flows through the controlled switch.

In carrying out my invention in one form, I provide means for controlling the conduction angles of a pair of alternately conducting thyristors in accordance with a variable command signal. The thyristors may be part of an a-c phase-controlled static switch adapted to be connected in an electric power system which includes an alternating voltage source and a reactive load circuit, and the magnitude of current flowing through the switch is a function of the conduction angle of the thyristors. The control means includes means for firing the alternate thyristors during successive half cycles of source voltage at gating angles determined by the magnitude of a gating control signal. The magnitude of the latter signal, which is effective during intermittent non-conducting intervals of the switch, depends on the sum of three signals: a control signal which is derived from the command signal and which has a magnitude indicative of the desired conduction angle; an off-time indicating signal that varies in magnitude as a direct function of the duration of each non-conducting interval; and an on-time indicating feedback signal directly proportional to the antecedent conduction angle (i.e., directly proportional to the actual conduction angle of the last conducting thyristor).

Each time the gating control signal magnitude reaches a predetermined threshold level, the next-to-conduct thyristor is fired and the off-time indicating signal is recycled. On a per unit basis, this threshold level is equivalent to twice the range over which the control signal varies to produce conduction angle variations from nearly zero to 180°. The on-time indicating feedback signal is related to the antecedent conduction angle by a proportionality constant approximately equal to 1 per unit 180°, and the magnitude excursion of the off-time indicating signal during a non-conducting interval approaching 180° is 2 per unit. With this arrangement, the conduction angle varies proportionately with the control signal as the latter is varied within the aforesaid range. The effect of the on-time indicating signal is to approximately double the conduction angle-to-control signal gain. Assuming a purely reactive power circuit, the deviation in the conduction angle initially responding to any step change in the control signal will therefore be consistent with the amount of that change, not twice as great, and the tendency for the initial conduction angle to overshoot is nullified. The magnitude of the on-time indicating feedback signal is updated during the initial conducting interval after the step change, thereby shifting the gating angle of subsequent thyristor firings as necessary to ensure equal conduction angles.

To linearize the magnitude relationship between the command signal and the fundamental current flowing through the switch, the control signal deriving means includes a non-linear interface which introduces a functional relationship between the command signal and the control signal that is a model of the non-linear function by which the fundamental current is related to the conduction angle.

To promote steady-state equality between the conduction angles of the two thyristors in spite of continuous unbalancing influences such as the presence in the control signal of a ripple of fundamental frequency and/or of certain harmonics thereof, I provide additional means including an integrator for producing during alternate non-conducting intervals of the switch a pair of balance indicating signals the mean value of which tracks the conduction angle so long as successive conducting intervals of the thyristors are equall to each other. If successive conduction angles are unequal, the value of each balance-indicating signal will deviate from its prior level by an amount which depends on the degree of imbalance, with the signal produced during the non-conducting interval after a relatively long conduction angle exhibiting a relatively positive magnitude increment proportional to the excess and with the signal produced after a shorter angle exhibiting an opposite change or decrement proportional to the conduction angle deficiency. These signals contribute in a corrective sense to the gating control signal so as to adjust the gating angles of the respective thyristors as necessary to ensure zero conduction angle balance error under all steady-state conditions. Preferably parameters are chosen so that the "gain" of the balance-indicating signal deviation is a predetermined fraction $x$ of 1 per unit per 90° of imbalance, while the proportionality constant relating the on-time indicating feedback signal to the antecedent conduction angle is $(1-x)$ per unit per 180°. This will preserve the above-described critical response of the initial conduction angle (no overshoot) after a step change in the control signal, with a reactive load being assumed. The fraction $x$ should be lower than one-fifth at which the gating control means exhibits critically damped response to conduction angle unbalancing effects. Higher fractions would risk oscillatory response.

My invention will be better understood and its various objects and advantages will be more fully appreciated from the following description taken in conjunction with the accompanying drawings in which:

FIG. 1 is a schematic diagram of a static switch with a gating control embodying a preferred form of the invention; and FIG. 2 is a graphic representation of certain electrical relationships that are present in the gating control of FIG. 1 over a period of nearly three full cycles of the source voltage.

Referring now to FIG. 1, there is shown an a-c power system 10 that comprises a source 12 of alternating voltage, a load circuit 14, and a static switch 16. The load circuit 14 and the static switch 16 are connected in series with each other across the terminals of source 12. The source voltage is assumed to be essentially sinusoidal, having a predetermined fundamental frequency such as 60 Hertz, and several cycles of this voltage are illustrated by the trace V in FIG. 2. The load circuit 14 is assumed to be of a type which results in a highly inductive power circuit. By way of example, the load could be purely inductive, as in the case of a static VAR control system wherein the switch 16 is used to vary the magnitude of reactive current flowing in such a load, as is disclosed in a copending U.S. patent application Ser. No. 406,139-Kelley et al, filed on Oct. 12, 1973, and assigned to the General Electric Company. Alternatively, the load 14 could comprise a tank circuit, such as an induction furnace shunted by a capacitor bank, which is tuned to the fundamental frequency but which is characterized by variable impedance while the switch 16 is in operation. In the event of an active load of the latter kind, the voltage waveform V illustrated in FIG. 2 is intended to represent the phasor difference between source and load voltages, and the predominant inductance in the power circuit is that associated with the source 12.

The illustrated static switch 16 comprises a complementary pair of alternately conducting controllable electric valves 17a and 17b which are connected in inverse parallel relationship with one another in the power system 10. While, for drawing simplicity, only a single thyristor symbol is used to represent each valve, in practice a plurality of thyristors can be connected in series and/or in parallel and operated in unison with one another to form high voltage, high current valves well suited for a high power system.

Each of the illustrated thyristors 17*a* and 17*b* has a non-conducting or blocking state, in which it presents very high impedance to the flow of current, and a conducting or turned on state in which it freely conducts forward current with only a relatively slight voltage drop. It can be switched abruptly from the blocking state to the turned on state by the concurrence of a forward bias on its main electrodes and a trigger or firing signal on its gate 21. Once fired, the thyristor 17*a* will conduct a pulse of positive or "forward" load current which ends at a natural current zero. When its current decreases below a given holding level, the thyristor 17a stops conducting and is commutated off. Subsequently the oppositely poled thyristor 17*b* is fired and commences to conduct a similar pulse of negative or "reverse" load current. The alternate pulses of current through the thyristors 17*a* and 17*b* are illustrated by the trace I in FIG. 2 for a condition wherein the gating angle $\alpha$ is greater than 90° but less than 180° and the conduction angle $\alpha$ is approximately 108°. The intermittent intervals when neither thyristor is conducting are denoted by the letter *a* in FIG. 2.

For controlling the gating angle and hence the conduction angle of each thyristor 17*a*, 17*b*, I provide a gating control 20 which responds to a unidirectional control signal $V_c$ received via an input control channel 22 to produce gating of the thyristors at gating angles dependent upon the magnitude of the control signal. The control signal in turn depends on the magnitude of a variable command signal $V_{in}$ from which it is derived. For reasons that will be explained hereinafter, a non-linear network 122 is preferably interposed between the control signal channel 22 and the command signal. By using the gating control to be described below, the conduction angles of the thyristor 17*a* and 17*b* can be varied in direct proportion to the magnitude of the control signal $V_c$. This signal will be assumed to vary within a range between substantially zero and a predetermined maximum positive magnitude M (which corresponds to one per unit) to vary the conduction angle from nearly zero to 180° (a half cycle of the fundamental frequency of the source voltage V). By using the non-linear network 122, the fundamental load current flowing through the switch 16 can be varied in direct proportion to the magnitude of the command signal $V_{in}$.

Certain parts of the gating control 20 shown in FIG. 1 correspond in construction and in operation to similar parts of the gating control disclosed in the above-referenced Kelley et al patents. These common parts have been given the same reference numbers as in the previous patents, and only a brief recapitulation of their description is believed necessary in this application. First of all, there is a voltage sensor 24 which senses the instantaneous voltage present across the static switch 16 and produces an output at 25 whenever this voltage exceeds a predetermined threshold value slightly higher than the maximum forward voltage drop across either of the thyristors when in a current conducting state. A thyristor voltage detector of the kind disclosed in U.S. Pat. No. 3,654,541-Kelley et al is well suited for this purpose. The output from the voltage sensor 24 is supplied via the channel 25 to a conventional function generator 27 which instantaneously responds to this output by developing a constant magnitude signal $F_a$ on its output channels 30, 31, and 32. Consequently the signal $F_a$ is coexistent with the intermittent non-conducting intervals of the switch 16, as is shown at 35 in FIG. 2.

The signal $F_a$ is supplied via channel 31 to a frequency attenuator 34, preferably in the form of an integrator, which develops on its output channel 36 an indicating signal $V_a$ that varies in magnitude as a function of the duration of the signal received via channel 31. This indicating signal, referred to hereinafter as the "off-time indicating signal", is shown at 38 in FIG. 2 where it can be seen to rise substantially linearly so long as the input signal 35 is received.

The frequency attenuator 34 is reset to a zero output condition by an associated reset circuit 70. The reset circuit is prevented from functioning so long as it receives an inhibit signal from the function generator 27 via channel 30. When the output $F_a$ of the function generator 27 expires, as a result of the decay of voltage across the switch 16, the channel 30 ceases supplying the inhibit signal to the reset circuit 70, and this circuit responds by resetting the frequency attenuator 34 and thereby recycling the off-time indicating signal $V_a$. Such resetting occurs each time a thyristor is fired to mark the end of a non-conducting interval or at the end of each forward voltage period across a thyristor, whichever comes first. The gain of the off-time indicating signal developing means is selected so that the magnitude excursion of $V_a$ during a non-conducting interval approaching 180° is approximately 2M.

In accordance with the present invention, the voltage sensor 24 produces another output at 125 whenever the voltage across the switch 16 is less than the aforesaid predetermined threshold value, indicating that one of the thyristors 17a, 17b is in its current conducting state. This output is supplied via channel 125 to a function generator 127 which responds thereto by developing a constant magnitude signal $F_b$ on its output channel 131. Consequently the signal $F_b$ is coexistent with the periodic conducting intervals of the switch 16, as is shown at 135 in FIG. 2.

The signal $F_b$ is supplied via channel 131 to another frequency attenuator 134, of the same form as the frequency attenuator 34, which develops on its output channel 136 an indicating signal $V_b$ having a magnitude during each of the intermittent non-conducting intervals of the switch that is proportional to the duration of the last signal received via channel 131. This indicating signal, referred to hereinafter as the on-time indicating signal, is thus a measure of the antecedent conduction angle, i.e., the actual conduction angle of the last conducting thyristor. It is shown at 138, in FIG. 2 where it can be seen to rise substantially linearly during each conducting interval of the switch from zero to a level proportional to the conduction angle of that interval, which level is maintained essentially constant throughout the succeeding non-conducting interval.

Periodically the frequency attenuator 134 is reset to a zero output condition by an associated reset circuit 170. This reset circuit operates in the same manner as the previously described reset circuit 70. Its reset function is normally inhibited but is periodically released or activated by the collapse of a signal received from the function generator 27 via channel 30 or, alternatively, by the rise of the signal $F_b$ from the function generator 127 which marks the start of a conducting interval of the static switch 16. In either case, the frequency attenuator 134 is reset and the on-time indicating signal $V_b$ is recycled simultaneously with the resetting of the frequency attenuator 34 and the recycling of the off-time indicating signal $V_a$. The gain of the on-time indicating signal developing means is selected so that the magnitude of $V_b$ is related to the antecedent conduction angle by a proportionality constant approximately equal to M/180°.

The on-time indicating signal $V_b$ is supplied via channel 136 to a summing circuit 40 that has five primary input channels 22, 36, 42, 82, and 136 and an output channel 44. The input channel 22 is the channel through which the control signal $V_c$ is supplied. The input channel 36 is the channel through which the off-time indicating signal $V_a$ is supplied to the summing circuit. The input channel 42 is a channel through which a relatively negative bias signal, if used, is supplied. As will be more fully explained hereinafter, the input channel 82 is a channel through which a balance-indicating signal $V_\sigma$ is supplied to indicate the difference, if any, between the respective conduction angles of the two thyristors 17a and 17b.

The summing circuit 40 is able to add together the signals supplied thereto via its separate input channels, provided it is turned on and maintained turned on by an enabling signal supplied via a permissive channel 46 from a permissive device 47. The permissive device 47 is simply a switch that effectively closes when supplied with the output of the function generator 27 via channel 32. So long as this permissive switch is closed, an enabling signal is supplied to the summing circuit 40, and this takes place only during and in coincidence with the intermittent non-conducting intervals of the static switch 16. During conducting intervals of the switch 16, the permissive device 47 acts to assure that the summing circuit will have an output of zero. It will be apparent that the function of the permissive device 47 could be implemented by other means. For example, the summing circuit 40 could always be allowed to develop its output at 44 if the control components which are activated by this output were blocked from responding thereto until the end of a conducting interval of the switch 16.

During each non-conducting interval of the switch, the summing circuit 40 is effective to provide at its output channel 44 a resultant signal $V_g$ having a magnitude which depends on the sum of the signals supplied to its various input channels. This resultant signal is referred to hereinafter as the "gating control signal". The gating control 20 includes suitable means responsive to $V_g$ for initiating the firing of the next to conduct thyristor when this signal reaches a predetermined threshold level equivalent to 2M. In the illustrated embodiment of my invention, this is accomplished by using a conventional positive-going zero crossing detector 54, after subtracting from the control signal $V_c$ a bias signal $V_{BIAS}$ having a constant magnitude equal to 2M. The difference between the latter signal and the variable control signal, which difference has a negative magnitude in a range from −2M to −M, will be referred to as the effective control signal.

During each of the non-conducting intervals of the switch, the gating control signal $V_g$ provided by the summing means 40 rises toward zero from a negative base level which varies with the sum of the effective control signal (indicating the desired conduction angle) and $V_b$ (indicating the antecedent conduction angle). Its rate of rise is the same as that of the off-time indicating signal $V_a$ (2M per 180°). If the control signal $V_c = 0$ and if the antecedent conduction angle is zero, the base level is approximately −2M and, asssuming that $V\sigma = 0$, the gating control signal on channel 44 will not reach zero before the end of a full half-cycle interval (180°). But when $V_c$ has a finite positive magnitude, the sum of the effective control signal and $V_b$ will be less negative and the zero crossing of $V_g$ will be advanced accordingly. The zero plus crossing detector 54 responds to the zero crossing of $V_g$ by immediately developing an output on channel 56 upon such a zero crossing.

The output from the zero plus cross detector 54 is supplied to a pulse generator 58 which immediately develops a short pulse on channel 60 in response to receipt of this output. The pulse on channel 60 is steered by suitable pulse steering means 66 to one of two pulse amplifiers 62 and 64 which immediately responds by firing the appropriate thyristor 17a or 17b, thereby initiating the next conducting interval of the static switch 16. The pulse steering means 66 is supervised by the voltage sensor 24, to which it is connected via a channel 67, so that whichever thyristor has forward bias voltage across its main electrodes is the one selected for firing. The pulse amplifiers 62 and 64 are coupled to the gates 21 of their respectively associated thyristors 17a and 17b by means of isolating transformers 69. These transformers and an isolating transformer in the voltage sensor 24 effectively insulate the gate control 20 from the power system 10.

As was previously explained, once a thyristor is fired it will conduct a pulse of load current the duration or angle ($\sigma$) of which depends on the gating angle ($\alpha$) at which the thyristor was fired and on the power factor of the power circuit in which the switch is connected. For purely inductive circuits, $\sigma = 2(180° - \alpha)$. The gating angle is determined by the timing of the zero crossing of the gating control signal $V_g$ which in turn depends on the magnitude of the control signal $V_c$. Under steady state, balanced conditions, and neglecting $V\sigma$, the time required for $V_g$ to cross the zero line following turn on of the summing circuit 40, which time corresponds to the non-conducting interval of the switch, equals its base level $2M-(V_c+V_b)$ divided by its rate of rise $2M/180°$, $V_b$ has substantially the same magnitude as $V_c$, and, assuming a purely inductive circuit, the non-conducting angle is $2(\alpha - 90°)$. It will therefore be apparent that under these conditions the conduction angle is directly proportional to the magnitude of the control signal $V_c$ (assuming that this signal has a magnitude within the prescribed range between 0 and M).

By increasing (or decreasing) the control signal $V_c$ a certain amount, the conduction angle of the switch 16 can be proportionately increased (or decreased). For example, if a conduction angle increase from 72° to 90° were desired, $V_c$ would be raised from 0.4M to 0.5M. Note that prior to such a step increase in the control signal, the on-time indicating signal $V_b$ is approximately 0.4M, the sum of $V_c$ and $V_b$ is approximately 0.8M, the non-conducting intervals are equal to $(2-0.8)M/2M$ 180° which is 108°, and the gating angle is consequently 144°. Although the control signal increase in this example is 0.1 per unit, the resulting foreshortening of the first non-conducting interval after the step increase is only half as much, namely 5 percent of 180°, and the gating angle of the next-to-conduct thyristor is advanced just 9° to a new, reduced value of 135°. This is because during the first non-conducting interval after the step increase the prior conduction angle, and hence the magnitude of $V_b$, is the same as before, whereby the quantity $2M-(V_c+V_b)$ is initially reduced from 1.2M to only 1.1M. Assuming a zero lagging power factor circuit, once the next-to-conduct thyristor is fired its conduction angle will change by twice the amount that the gating angle has changed, and thus the conduction angle that initially responds to the step increase will increase 18° to precisely the desired value, namely, 90°. It is therefore apparent that the dynamic response of my gating control avoids overshoot of the initial conduction angle after a step change in the control signal.

Once the initial conduction angle has increased to 90° in the foregoing example, $V_b$ increases proportionately to approximately 0.5M. Consequently, during the second and succeeding non-conducting intervals after the step increase, the sum of $V_c$ and $V_b$ is M, the duration of these intervals is appropriately reduced to a new steady state value of $(2-1.0)M/2M$ 180° which is 90°, the gating angle remains 135°, and consequently the conduction angle remains equal to 90°. In effect the on-time indicating signal $V_b$ serves to regulate the gating control so as to ensure conduction angle balance. When the antecedent conduction angle first increases to 90°, $V_b$ increases correspondingly to shorten the next non-conducting angle which thereby lengthens the succeeding conduction angle to 90°.

The gating control thus far described is capable of responding to a step change in the control signal without overshoot of the initially responding conduction angle and without oscillations of the subsequent conduction angles. This ideal dynamic response is nevertheless not alone sufficient to ensure proper operation of the control under certain conditions which involve steady state unbalancing influences. Such influences cannot practically be entirely eliminated. Among the unbalancing forces most likely to be experienced is a ripple on the control signal due to the fundamental and/or odd harmonic frequencies of the alternating voltage source 12. Another common unbalancing influence is due to anomalies and dissymmetries in the components and subcircuits of the controls. For example, during alternate half cycles of operation the frequency attenuator 34 (and 134) may produce output signals that are not precisely matched in slope or in recycling times. If successive conduction angles were allowed periodically to fluctuate in response to such unbalancing influences, the alternating current pulses conducted by the switch 16 would have an undesirable asymmetrical characteristic.

In order to nullify any steady state unbalancing influence, the illustrated gating control 20 includes an improved conduction angle balancing circuit 180 which preferably comprises a function generator 184 generally similar to the previously described function generator 127. The function generator 184 is driven by suitable means, such as the voltage sensor 24 to which it is connected over channel 26, for indicating when and which one of the thyristors 17*a* and 17*b* is in its current conducting state, and in response to this indication it periodically develops an output $F_\sigma$ which is a train of alternate first and second signals 87 and 86 respectively coexistent with the conducting intervals of the thyristors 17*b* and 17*a*. These signals are shown by the trace $F_\sigma$ in FIG. 2 where it will be seen that the first signal 87 has a substantially constant magnitude and the same relative polarity (positive) as the on-time indicating signal $V_b$ while the second signal 86 has the same magnitude but opposite polarity (negative) as the first signal 87.

Both of the signals 87 and 86 are fed to the input of a frequency attenuator 89, in the form of an integrator, which produces an output signal that is the time integral of its input signals. This output signal from the conduction angle balance integrator 89 is shown below the trace $F_\sigma$ in FIG. 2 and during each conducting interval its magnitude will be seen to change in the direction of the then effective input signal 87 or 86. More specifically, the output signal increases negatively at a substantially linear rate throughout each period of the input signal 86 which coincides with the conducting interval of the thyristor 17*a* (see 90 in FIG. 2), and it increases positively at the same rate throughout each period of the input signal 87 which coincides with the alternate conducting interval of the oppositely poled thyristor 17*b* (see 91 in FIG. 2). The gain of the conduction angle balancing circuit is selected so that the magnitude excursion of the output signal during a conducting interval of 90° is $x$M, where $x$ is a predetermined fraction less than approximately one-fifth. In the illustrated embodiment of my invention, $x = 0.1$, but in practice it may be much lower. Matters to be considered in the selection of this fraction are explained hereinafter. It will however be noted here that with the addition of the conduction angle balancing circuit to the gating control 20, the aforesaid proportionality constant which relates the magnitude of the on-time indicating signal $V_b$ to the antecedent conduction angle should actually be equal to $(1 - x)M/180°$. This proportionality constant has been indicated in FIG. 2, and in the illustrated embodiment of my invention its value is 0.9M per 180°.

During the intermittent non-conducting intervals of the switch 16, when both of its input signals 87 and 86 are zero, the conduction angle balance integrator 89 holds its output signal substantially constant. The output signal is labeled 92 during the non-conducting intervals immediately preceding the cyclic firings of the thyristor 17*a*, and this signal is channeled to suitable gating means 95 which is effective only during these intervals to supply the signal 92 to the summing means 40 via the channel 82. Thus the output signal 92 serves as the balance-indicating signal $V_\sigma$ during those non-conducting intervals that begin with the commutation of thyristor 17*b* and end with the firing of thyristor 17*a*. At all other times the gate 95 blocks the output of the balance integrator 89, for which purpose it is controlled by an associated permissive circuit 96 which in turn is coupled via channel 33 to the function generator 184 so as to be able to discriminate between the conducting and non-conducting intervals of the respective thyristors 17*a* and 17*b*.

The output signal of the conduction angle balance integrator 89 during the non-conducting intervals immediately preceding the cyclic firings of the thyristor 17b is labeled 94. This signal is channeled to another gating means 95*a* by way of a polarity inverter 97 which reverses its polarity. The gate 95*a* is under the control of a permissive circuit 96*a* which is coupled by way of a complementary channel 33*a* to the function generator 184. Normally the gate 95*a* is in a blocking state, but during the last-mentioned intervals it is effective to supply the inverted output signal 94 to the summing means 40 via the channel 82, Thus during those non-conducting intervals that begin with the commutation of thyristor 17*a* and end with the firing of thyristor 17*b* the balance-indicating signal $V_\sigma$ is equal in magnitude but inverted in polarity to the output signal 94 of the balance integrator 89.

The resulting pair of balance-indicating signals 92 and 94 (inverted) which are fed to the summing means 40 are shown in FIG. 2 by the trace $V_\sigma$. During the intermittent non-conducting intervals of the switch, alternate ones of these signals are added to the previously described signals which the summing means 40 receives via its other input channels 22, 36, 42, and 136. The output which the summing means 40 provides during each non-conducting interval is the gating control signal $V_g$. The latter signal therefore equals the sum of $V_c+V_a+V_b+V_\sigma-V_{BIAS}$, and it is illustrated in FIG. 2 by the solid-line ramp 50. Each time the ramp 50 crosses the zero line, the next-to-conduct thyristor is fired.

So long as there is no imbalance between successive conduction angles (i.e., the conducting interval of the thyristor 17*a* equals that of the thyristor 17*b*, and vice versa) and there is no unbalancing influence in the gating control, each of the pair of balance-indicating signals 92 and 94 (inverted) will have the same value which is proportional to the size of the conduction angle. In this steady state condition, the value of these signals is a positive magnitude equal to $xM/90°. \sigma/2$. By way of example, if $\sigma = 108°$ and $x = 0.1$, the value of each balance-indicating signal is 0.06M. This particular example has been illustrated on the left hand side of FIG. 2. Noting that the magnitude of the on-time indicating signal $V_b$ is $(1-X)M/180°\sigma$, for the given conditions $V_b = 0.54M$ and the sum of $V_b$ and $V_\sigma$ is 0.6M which equals the magnitude of the control signal $V_c$.

The value of each balance-indicating signal 92, 94 (inverted) will deviate from its steady state level if successive conduction angles have become unequal to each other. In this event, the balance integrator 89 is effective during each conducting interval to change the value of the succeeding output signal, compared to the prior level of the same signal, by an amount proportional to the degree of imbalance and in a direction reflecting whether the conduction angle has been longer or shorter than the preceding one. If the conduction angle is relatively long, the magnitude of the succeeding balance-indicating signal exhibits a relatively positive increment proportional to the differences between that angle and the conduction angle preceding it. On the other hand, if the conduction angle is relatively short, the magnitude of the succeeding balance-indicating signal will exhibit an opposite change or decrement proportional to the conduction angle deficiency. Such deviations in the balance-indicating signals contribute in a corrective sense to the gating control signal $V_g$; a positive increase in a balance-indicating signal correspondingly raises the negative base level from which $V_g$ rises during the associated non-conducting interval, thereby advancing the gating angle and lengthening the conduction angle of the next-to-conduct thyristor; whereas a positive decrease (negative increase) in a balance-indicating signal correspondingly lowers the base level, thereby retarding the gating angle and shortening the conduction angle of the next-to-conduct thyristor. In either case the conduction angle of the next-to-conduct thyristor is shifted in a direction tending to force this angle to equal the immediately preceding conduction angle.

Having described the complete gating control 20 shown in FIG. 1, including the conduction angle balancing circuit 180, I will now review its operation with reference to FIG. 2. It will be assumed that prior to time 100 in FIG. 2 the gating control has been operating symmetrically, with no unbalancing influence, and that throughout the operation to be described the command signal $V_{in}$ is not varied from a magnitude that is intended to yield a conduction angle of 108° (0.6 per unit). Consequently, during each of the non-conducting intervals prior to time 100 the values of $V_c$, $V_b$, and $V_\sigma$ are $+0.6M$, $+0.54M$, and $+0.06M$, respectively, and their sum equals 1.2M which is consistent with the desired non-conducting angle of 0.4 per unit (72°). It is further assumed that beginning at the time 100, which falls during a conducting interval of the thyristor 17*a*, the control signal $V_c$ has superimposed thereon a fundamental-frequency ripple which alternately increases and decreases $V_c$ by approximately 0.1 per unit. In the manner previously described, the step increase in $V_c$ at time 100 causes the gating angle of the next-to-conduct thyristor (17*b* ) to advance 0.05 per unit (9°), thereby increasing the initially responding conduction angle by twice as much (18°). Thus the actual period of the first current pulse N. 1 after time 100 conforms without overshoot to the step increase in $V_c$ but is 18° longer than desired.

At the end of this longer conduction angle, both the on-time indicating signal $V_b$ and the first balance-indicating signal 92 ($V_\sigma$) will have increased in proportion to the excess. $V_b$, which changes at a rate of 0.9M per 180°, increases from 0.54M to 0.63M, and 92, which changes at a rate of 0.1M per 90°, increases from 0.06M to 0.08M. In the meanwhile, however, the ripple on $V_c$ has caused the net magnitude of this signal to decrease from 0.7M to 0.5M, and consequently during the ensuing non-conducting interval the sum of $V_c + V_b + V_\sigma$ is 1.21M which means that the duration of this interval is reduced to 0.395 per unit (approximately 71°). Therefore the firing incidence of the next-to-conduct thyristor 17*a* is shifted by an amount and in a direction that results in the next current pulse No. 2 having a conduction angle of approximately 92° which is shorter than desired.

At the end of this shorter conduction angle, the on-time indicating signal $V_b$ has a new magnitude proportional thereto (approximately 0.46M), and the second balance-indicating signal 94 (inverted) will have changed from its prior level by an amount $-\Delta v$ proportional to the angular deficiency of this angle compared to the initial conduction angle (i.e., a decrement of 0.038 per unit, form + 0.06M to + 0.022M). In the meanwhie, the ripple on $V_c$ has increased the net magnitude of this signal from 0.5M to 0.7M, and consequently during the succeeding non-conducting interval the sum of $V_c + V_b + V_\sigma$ is approximately 1.18M which is consistent with a non-conducting angle of 0.41 per unit (73.8°. This shifts the gating angle of the next-fired thyristor 17*b* so that the third current pulse No. 3 after the 100 has a conduction angle of approximately 120.6° which is shorter than the initial conduction angle but still longer than desired.

The transient response of the gating control as described in the preceding two paragraphs is repeated for many additional half cycles (not shown in FIG. 2). During each succeeding cycle there is a slight increase in the short conduction angle of thyristor 17*a* and a slight decrease in the long conduction angle of the alternately conducting thyristor 17*b* until both converge at the desired conduction angle of 108°. During successive steps of this process, each of the balance-indicating signals 92 and 94 (inverted) will deviate from its prior level by a progressively diminishing amount, and at the end of the transient response, when conduction angle equality is achieved, the values of these two signals will have diverged to + 0.16M and − 0.04M, respectively. Now these signals have a mean value (+0.06M) which is correctly proportional to the actual conduction angle (108°), and thereafter they remain substantially constant so as to enable the gating control to operate in a steady state with zero conduction angle error in spite of the unbalancing influence of the ripple on the control signal $V_c$.

It should now be apparent that adding the illustrated conduction angle balancing circuit 180 to the gating control 20 effectively nullifies steady state unbalancing forces. This is advantageous in practical applications of my invention where such unbalancing forces are ordinarily present. Unfortunately, however, it also tends to counteract the ideal conduction angle balancing effect of the on-time indicating signal $V_b$ in response to step changes in the command signal $V_{in}$. To reduce the transient conduction angle error, subsequent to the initial conduction angle after a step change in the command signal, I prefer to appreciably overdamp the control by using a relatively low gain in the conduction angle balancing circuit so that the fraction $x$ is well below one-tenth. The low gain is feasible since the antecedent conduction angle feedback signal ($V_b$) tends to stabilize the conduction angle balance loop 180 so long as $x$ is less than 0.25. In any event the fraction x should be lower than approximately one-fifth at which a critically damped response is obtained.

So long as the power circuit is purely inductive, the dynamic response of my gating control is ideal (no overshoot of the conduction angle initially responding to a step change in the command signal) if, as in the previously described embodiment, the gain of the means for developing $V_b$ plus one-half the gain of the means for deriving $V_\sigma$ are equal to 50 per cent of the gain of the means for developing $V_a$. Relatively small deviations in this relationship can be tolerated in practice without appreciably diminishing the quality of the controls. In higher power factor circuits this particular relationship will cause undershoot of the initial conduction angle after a step change in the command signal, and in designing a gating control for a static switch useful in such circuits the feedback contribution of the two signals $V_b$ and $V_\sigma$ may therefore be reduced from 50 percent to engender optimum dynamic response. However, if the power factor is variable, the 50 percent figure is preferred to avoid any possibility of undesired oscillatory response.

In operation, the fundamental current conducted by the static switch 16 in a purely inductive power circuit is proportional to $1/\pi\ (\sigma - \sin\sigma)$. Since the conduction angle $\sigma$ is directly proportional to the control signal $V_c$, it follows that the fundamental current is not linearly related to $V_c$. To linearize this relationship, all of the frequency attenuators shown in FIG. 1 could be constructed with judiciously selected multiple time constants. A simpler way to obtain the same result is to use the non-linear network 122 between the command signal $V_{in}$ and the control signal input channel 22. The input network 122 is suitably constructed and arranged so that its $V_{in}$ vs. $V_c$ characteristic matches the fundamental current vs. $V_c$ characteristic. This can be done, for example, by using a fucntion generator having a non-linear transfer function characterized by a gain which decreases with increasing $V_{in}$.

While I have shown and described one form of my invention by way of illustration, many modifications will occur to those skilled in the art. Furthermore, the invention can advantageously be used to control the gating of complementary pairs of alternately conducting valves arranged in configurations other than the illustrated a-c static switch. I contemplate, therefore, by the claims which conclude this specification to cover all such modifications as fall within the true spirit and scope of the invention.

What I claim as new and desire to secure by Letters Patent of the United States is:

1. A gating control for a complementary pair of alternately conducting controllable electric valves which are cyclically fired at gating angles that can be varied to control the subsequent conduction angel of each valve in turn, said gating control comprising:

a. first means for supplying a control signal having a magnitude indicative of the conduction angles desired for said valves;

b. second means for developing an on-time indicating signal having a magnitude during each of the intermittent intervals when neither valve is conducting that is proportional to the actual conduction angle of the last conducting valve;

c. third means for developing an off-time indicating signal that varies in magnitude as a function of the duration of each of said intermittent non-conducting intervals;

d. summing means connected to said first, second, and third means and effective during each non-conducting interval for providing a gating control signal the magnitude of which depends on the sum of all three of said signals; and e. means responsive to said gating control signal for initiating the firing of the next to conduct valve when said gating control signal reaches a predetermined threshold level.

2. The gating control of claim 1 for a pair of valves connected in an electric power system including a source of alternating voltage having a predetermined fundamental frequency, in which said control signal is variable over a range between substantially zero and a predetermined magnitude ("M") which range corresponds to desired conduction angle variations from nearly zero to 180 electrical degrees (a half cycle of said predetermined frequency), said on-time indicating signal is related to the actual conduction angle of the last conducting valve by a proportionality constant approximately equal to M/180°, and the magnitude excursion of said off-time indicating signal during a non-conducting interval approaching 180° is approximately 2M.

3. The gating control of claim 1 including additional means for comparing the respective conduction angles of said valves on successive conducting intervals and for deriving a balance-indicating signal having a value which deviates from a steady state level in the event of a conduction angle imbalance, said summing means being connected to said additional means so that said balance-indicating signal contributes in a corrective sense to the sum on which said gating control signal magnitude depends, whereby the firing incidence of the next to conduct valve is shifted in a direction tending to produce equal conduction angles during successive conducting intervals.

4. The gating control of claim 3 wherein said second and third means and additional means have predetermined gains which are so chosen that the sum of the gain of said second means and one-half the gain of said additional means is approximately equal to 50% of the gain of said third means.

5. The gating control of claim 1 including additional means for producing during alternate non-conducting intervals of said valves a pair of balance-indicating signals the mean value of which is proportional to the conduction angle of the valves so long as successive conducting intervals are equal to each other, said additional means including an integrator and being effective in the event of a conduction angle imbalance to change the value of each of said pair of signals by an amount proportional to the degree of imbalance and in a direction reflecting whether the immediately preceding conducting interval was longer or shorter than the one before that, said summing means being connected to said additional means so that said balance-indicating signals contribute in a corrective sense to the sum on which said gating control signal magnitude depends, whereby the firing incidence of the next to conduct valve is shifted in a direction tending to produce equal conduction angles during successive conducting intervals.

6. The gating control of claim 5 for a pair of valves comprising at least first and second thyristors connected in inverse parallel realtionship with one another in an electrical power system which includes a source of alternating voltage having a predetermined fundamental frequency, in which said additional means comprises means for periodically developing first and second signals coexistent with the conducting intervals of said first and second thyristors, respectively, said first signal having a substantially constant magnitude and the same relative polarity as said on-time indicating signal and said second signal having the same magnitude but the opposite polarity as said first signal, integrating means to which both of said first and second signals are supplied for producing an output signal which is the time integral of said first and second signals, means effective during the non-conducting intervals immediately preceding the cyclic firing of said second thyristor for supplying said output signal to said summing means, whereby said output signal serves as one of said pair of balance-indicating signals during these intervals, and means effecting during the non-conducting intervals immediately preceding the cyclic firing of said first thyristor for supplying to said summing means the other balance-indicating signal which is equal in magnitude but inverted in polarity to said output signal during such intervals.

7. The gating control of claim 6 in which said control signal is variable over a range between substantially zero and a predetermined magnitude ("M") which range corresponds to desired conduction angle variations from nearly zero to 180 electrical degrees (a half cycle of said predetermined frequency), the magnitude excursion of said off-time indicating signal during a non-conducting interval approaching 180° is approximately 2M, the magnitude excursion of said output signal during a 90° conducting interval is $x$ M, where $x$ is a predetermined fraction lower than approximately one-fifth, and said on-time indicating signal is related to the actual conduction angle of the last conducting thyristor by a proportionally constant equal to $(1-x)/180°M$.

8. The gating control of claim 1 for a pair of valves connected in inverse parallel relationship with one another to form a static switch in an electric power system which includes a source of alternating voltage having a predetermined fundamental frequency, the magnitude of fundamental current flowing through said switch being a predetermined non-linear function of said conduction angle, in which said first means of said gating control includes non-linear means for deriving said control signal from an external command signal of variable magnitude, said non-linear means being so constructed and arranged that the magnitude of said command signal is related to the magnitude of said control signal by said predetermined non-linear function, whereby the fundamental current varies linearly with said command signal.

* * * * *